United States Patent [19]

Rex

[11] 4,245,871

[45] Jan. 20, 1981

[54] CENTRALIZED VIDEO OR AUDIO CENTER DISPLAY DEVICE

[75] Inventor: Roger Rex, Hales Corners, Wis.

[73] Assignee: Display Corporation International, Milwaukee, Wis.

[21] Appl. No.: 51,845

[22] Filed: Jun. 25, 1979

[51] Int. Cl.[3] ..... A47B 87/00; A47B 95/18

[52] U.S. Cl. ..... 312/223; 312/198; 312/250; 312/279

[58] Field of Search ..... 312/7, 9, 10, 12, 140.2, 312/196, 198, 213, 278, 279, 223, 250

[56] References Cited

U.S. PATENT DOCUMENTS

| | | | |
|---|---|---|---|
| 2,637,616 | 5/1953 | MacDonald | 312/278 |
| 3,043,642 | 7/1962 | Nelson et al. | 312/198 |
| 3,131,010 | 4/1964 | Erath | 312/213 |
| 3,926,487 | 12/1975 | Reyes | 312/213 |
| 3,997,218 | 12/1976 | Wolf et al. | 312/279 |

*Primary Examiner*—Casmir A. Nunberg

[57] ABSTRACT

A display device comprises a lower frame unit which forms a cabinet having an interior storage area and a hinged access door. An upper frame unit is supported on and above the cabinet and includes a shelf spaced over and above the top of the cabinet. A video tape machine may be supported on the cabinet, and a television set may be supported on the shelf in a generally stacked relationship above the video tape machine. The electrical wiring for both the video tape machine and television set is contained within the device where it is concealed from sight and possible tampering.

5 Claims, 3 Drawing Figures

CENTRALIZED VIDEO OR AUDIO CENTER DISPLAY DEVICE

FIELD OF THE INVENTION

The invention relates generally to floor display devices and, more particularly, to a unitary device which holds the various component parts of a video or audio system to thereby serve as an integrated video or audio center.

RELATED APPLICATION

Attention is directed to pending design patent application entitled "VIDEO CENTER" filed by Roger Rex on Feb. 26, 1979 and assigned Ser. No. 15,483.

SUMMARY OF THE INVENTION

The invention provides a device comprising a lower frame unit which forms a cabinet having an interior storage area and which is adapted to support a video tape machine or the like atop the storage area. The cabinet has a hinged access door movable between an open position permitting access into the interior storage area and a closed position which blocks such access. An upper frame unit is supported on the cabinet and includes a pair of oppositely spaced sidewalls which adjoin the cabinet on opposite sides of the access door and a vertical back panel which is supported between the sidewalls. A horizontal shelf is also supported between the sidewalls in a spaced relationship generally over and above the top of the cabinet. This shelf is adapted to support a television set or the like in a convenient generally stacked relationship above the component which is supported atop the cabinet.

In accordance with the preferred embodiment of the invention, each of the sidewalls has an inwardly notched or "cut-away" section formed directly above the cabinet to facilitate access to the video tape machine as well as facilitate circulation of air around that machine.

In addition, the upper frame unit includes a narrow top panel which is spaced above and parallel to the shelf. This forms a truncated area, having an open portion at the top rear thereof in the preferred arrangement. A television set can be accommodated in the generally open truncated area formed between the shelf and the narrow top panel. The upper portions of the upper frame unit sidewalls are obliquely slanted downwardly from the truncated top panel toward the back panel defining a generally open area around the television set to facilitate circulation of air.

Also in the preferred embodiment, an interior void area is located in the area between the top of the cabinet and the shelf, and in which electrical hook-up wires can be confined and thus hidden from view and tampering.

Furthermore, the device includes wheels attached to the bottom panel so that the device is mobile.

DESCRIPTION OF THE PREFERRED EMBODIMENT

Figure 1:
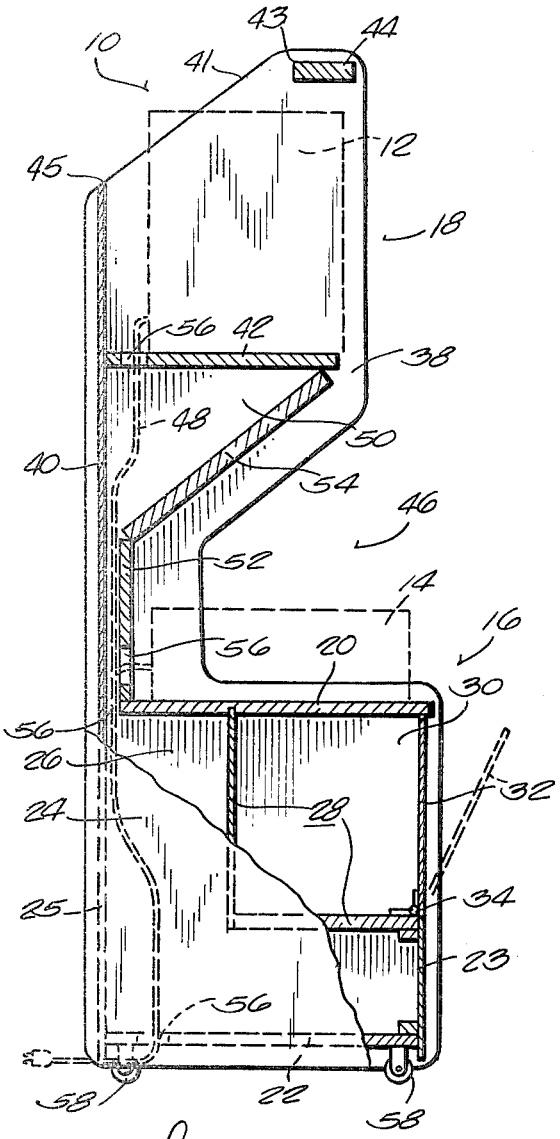
FIG. 1 is a side view, partially broken away, of a device which supports a television set in a vertically stacked relationship above a video tape machine.

A device 10 is shown in the drawings which supports a television set 12 (shown in phantom lines in FIG. 1) in close proximity to a cassette video tape machine 14 (also shown in phantom lines in FIG. 1), thereby serving as a centralized "video center" which facilitates the recording and/or playback of video tape cassettes. While the device 10 will hereafter be described as being a "video center", it is to be appreciated that the device 10 is suitable for other uses, such as, for example, conveniently supporting the various component parts of a stereo system and thereby serving as an integrated "audio center".

Structurally, the device 10 is divided into a lower frame unit 16 upon which the video tape machine 14 is supported and an upper frame unit 18 upon which the television set 12 is supported in generally stacked relationship above the video tape machine 14.

While the frame units 16 and 18 of the device 10 may be constructed of various materials and in differing dimensions, in the illustrated embodiment the lower and upper frame units 16 and 18 are constructed of wood or particleboard fastened together by nails or glue. They are proportioned such that the video tape machine 14 is supported on the device 10 at or near the waist level of the viewer and the television set 12 is supported on the device 10 at or near eye level.

Referring now to the particular embodiment illustrated, the lower frame unit 16 forms a cabinet having by a top panel 20, a bottom panel 22, and four adjoining side panels 23, 24, 25, and 26. The interior portion of the cabinet 16 is compartmentalized by additional panels 28 so as to form a partitioned interior storage area 30 which can be used for the storage of video tape cassettes and the like. As can be seen in FIG. 1, the video tape machine 14 is supported upon the top panel 20 of the cabinet 16.

In the illustrated embodiment, one of the side panels 23 forms a front panel and includes a pivotally attached upper portion 32, such as by the use of a hinge 34, to serve as an access door which is movable between an open position (shown in phantom lines in FIG. 1) to permit access into the interior storage area 30 and a closed position (shown in solid lines in FIG. 1) to block access and seal off the interior storage area 30. A conventional locking assembly 36 (see FIG. 2) may be provided to lock the door 32 in the closed position.

The upper frame unit 18 of the device 10 is supported on and extends above the cabinet 16. More particularly, the upper frame unit 18 includes a pair of oppositely spaced sidewalls 38 and 39 which, in the illustrated embodiment, are integral extensions of the side panels 24 and 26 which are spaced on opposite sides of the access door 32. A back panel 40 extends vertically between the sidewalls 38 and 39, and, in the illustrated embodiment, is an integral extension of the side panel 25 which is opposite to the access door 32.

Figure 3:
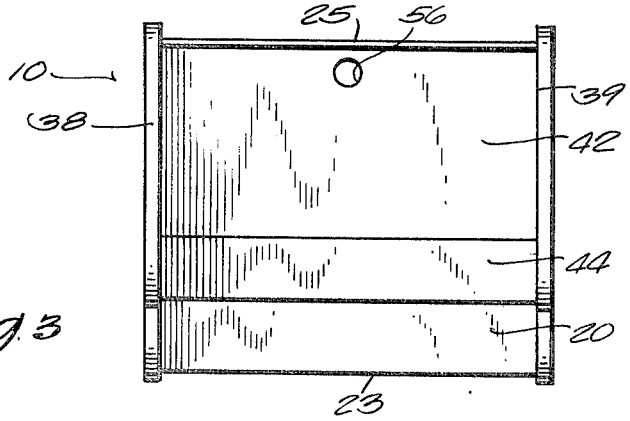
FIG. 3 is a top view of the device.

A shelf 42 is supported between the sidewalls 38 and 39 in a spaced relationship over and above the top panel 20 of the cabinet 16. A top panel 44 is located between the sidewalls 38 and 39 generally spaced above and parallel to the shelf 42. The top panel 44 is narrow relative to shelf 42 and edges 41 of sidewalls 38 and 39 are beveled to define a generally truncated space in which the television set 12 is accommodated. By virtue of the truncated space, the area above the shelf 44 is virtually open (as is best seen in FIGS. 1 and 3) to permit the free circulation of air around the television set 12, thereby facilitating the venting of heat which is generated by the operation of the television set 12.

To facilitate operator access to the video tape machine 14, the sidewalls 38 include an inwardly notched or "cut-away" section 46 (see FIG. 1) located just above the top cabinet panel 20. The relatively open-sided area thus defined in the vicinity of the video tape machine 14 also enhances the free circulation of air about and removal of heat from the video tape machine 14.

The electrical wires 48 (shown in phantom lines in FIG. 1) which conduct electricity to the television set 12 and the video tape machine 14 and interconnect the television set 12 with the video tape machine 14, are located within an interior void 50 which is formed between the back panel 40 and panels 52 and 54 and are thereby hidden from view and protected against tampering. More particularly, a supplemental back panel member 52 is attached to the top panel 20 and located in a closely spaced and parallel relationship to a portion of the back panel 40. A generally obliquely disposed supplemental exterior panel 54 is attached between the upper edge of the supplemental back panel 52 and the front edge of the shelf 42 and, together with the supplemental back panel 52, closes off the void area 50. The electrical wires 48 pass into this void area 50 through a series of holes 56 which are formed in the rear portion of the shelf 42, in the supplemental back panel 52 and in the rear portion of the bottom panel 22. The wires pass between back panel 40 and the top panel 20 and the supplemental back panel 52.

Figure 2:
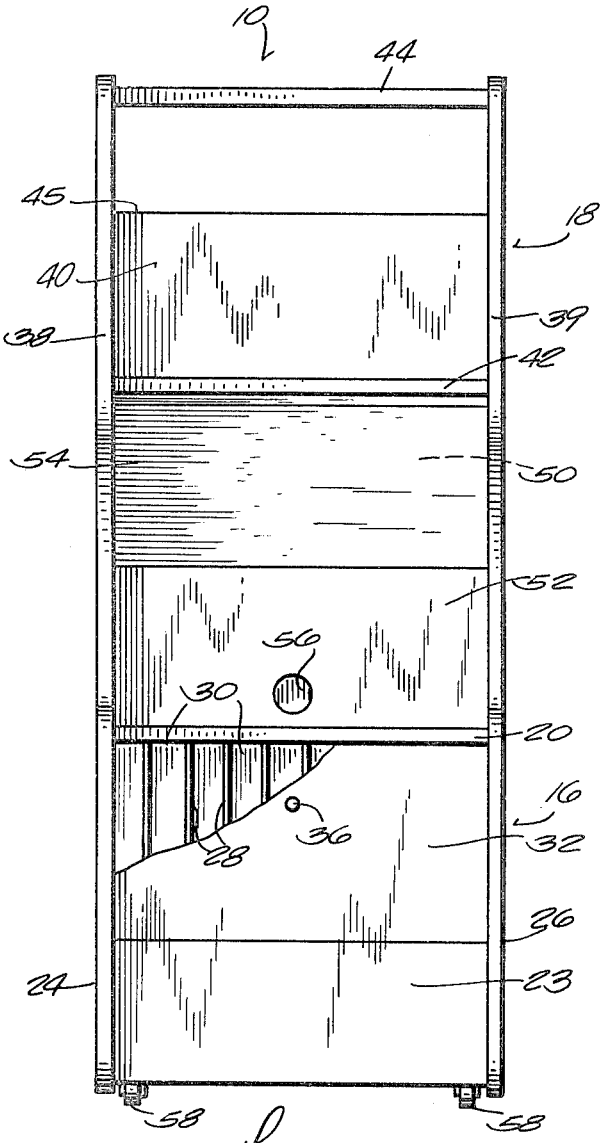
FIG. 2 is a front view, partially broken away, of the device shown in FIG. 1.

As can be seen in FIGS. 1 and 2, the device 10 includes wheels 58 which are attached to the corners of the bottom panel 22 and which enable movement of the device 10 easily over the floor or ground.

With the described arrangement the television set and video cassette recorder are supported in operative association one with the other. Pre-recorded cassettes can be played through the television set for point of purchase promotion. The arrangement is attractive, compact and relatively tamper-proof by virtue of the concealed electrical wiring and the enclosed cassette storage space. In addition, the components are closely arranged to permit facile recording of cassettes from broadcast television programming if desired.

Although but one embodiment of the present invention has been illustrated and described, it will be apparent to those skilled in the art that various changes and modifications may be made therein without departing from the spirit of the invention or from the scope of the appended claims.

I claim:

1. A display device for commonly supporting a television set and a cassette video tape machine in operative association one with the other comprising:

a lower frame unit including a generally planar top, a bottom wall, spaced side panels joined to said top and said bottom wall, a front panel and a rear panel together generally defining a cabinet having an interior storage area and adapted to support the video tape machine upon said top, said front panel having a pivotally attached portion providing an access door movable between an open position permitting access into said interior storage area and a closed position blocking access, and an upper frame unit supported on and above said lower frame unit and including a pair of oppositely spaced sidewalls joined to said side panels, each of said sidewalls having an inwardly notched section formed therein generally adjacent to said top of said lower frame unit to facilitate access to and the circulation of air about the video tape machine, a generally planar, horizontal shelf supported between said sidewalls above said inwardly notched section and in a spaced relationship generally over and above said top of said lower frame unit, a top panel supported between said sidewalls in a spaced relationship from and above the forward portion of said shelf, said top panel being narrower than said shelf, a vertical back panel supported between said sidewalls and joined to said rear panel and terminating at a point which is generally intermediate said shelf and said top panel, each of said sidewalls further including a generally obliquely slanted upper portion extending between the termination of said back panel and said top panel and together with said top panel and said shelf forming a generally open, truncated area at the rear top of said upper frame unit in which the television set is accommodated to facilitate the circulation of air about the television set.

2. A display device according to claim 1 and further including a supplemental back panel member having a first opening formed therein, said supplemental back panel member being attached to said top of said lower frame unit and located in a closely spaced and parallel relationship with said back panel, and a generally obliquely disposed supplemental exterior panel member supported between said supplemental back panel member and said shelf, said supplemental back panel member and said supplemental exterior panel member thereby forming a void area between said supplemental back and exterior panel members and said back panel, wherein said shelf has a second opening formed therein near the intersection of said shelf with said back panel and communicating with the void area, wherein top of said lower frame unit has a third opening formed therein and communicating with the void area, wherein said bottom panel has a fourth opening, and whereby the television set and the video tape machine may be electrically connected to a source of electricity and electrically connected with each other by electrical hook-up wires passing through said first, second, third and fourth openings and into and through the void area formed between said back panel and said adjoining supplemental back panel and supplemental exterior panel members.

3. A display device according to claim 2 and further including a plurality of support wheels attached to said bottom panel for facilitating movement of said device.

4. A display device for commonly supporting a television set and a cassette video tape machine in operative association one with the other comprising:

a lower frame unit including a generally planar top, a bottom wall, spaced side panels joined to said top and said bottom wall, a front panel a rear panel together generally defining a cabinet having an interior storage area and adapted to support the video tape machine upon said top, said front panel having a pivotally attached portion providing an access door movable between an open position permitting access into said interior storage area and a closed position blocking access, an upper frame unit supported on and above said lower frame unit and including a pair of oppositely spaced sidewalls joined to said side panels, a vertical back panel supported between said sidewalls and joined to said rear panel, and a generally planar, horizontal shelf supported between said sidewalls in a spaced relationship generally over and above said top of said lower frame unit, said shelf being adapted to support the television set in a generally stacked relationship above the video tape machine, a supplemental back panel member having a first opening formed therein, said supplemental back panel member being attached to said top of said lower frame unit and located in a closely spaced and parallel relationship with said back panel, and a generally obliquely disposed supplemental exterior panel member supported between said supplemental back panel member and said shelf, said supplemental back panel member and said supplemental exterior panel member thereby forming a void area between said supplemental back and exterior panel members and said back panel, said upper frame unit shelf further having a second opening formed therein near the intersection of said shelf with said back panel and communicating with the void area, said top of said lower frame unit further having a third opening formed therein and communicating with the void area, said bottom panel further having a fourth opening, and whereby the television set and the video tape machine may be electrically connected to a source of electricity and electrically connected with each other by electrical hook-up wires passing through said first, second, third and fourth openings and into and through the void areas formed between said back panel and said adjoining supplemental back panel and supplemental exterior panel members.

5. A display device according to claims 1 or 4 and further including a plurality of support wheels attached to said bottom panel for facilitating movement of said device.

* * * * *